US005983532A

United States Patent [19]

McGrath et al.

[11] Patent Number: 5,983,532

[45] Date of Patent: Nov. 16, 1999

[54] SNOWSHOE FOOT CLAMP

[76] Inventors: Joseph M. McGrath, 26 Woldbrook Dr., Windham, Me. 04062; Roy A. Schnuell, W. 2838 Hickory Hills Rd., Chilton, Wis. 53014

[21] Appl. No.: 09/061,206

[22] Filed: Apr. 16, 1998

[51] Int. Cl.[6] ..... A43B 5/04

[52] U.S. Cl. ..... 36/125; 36/122

[58] Field of Search ..... 36/122, 123, 124, 36/125

[56] References Cited

U.S. PATENT DOCUMENTS

| | | | |
|---|---|---|---|
| 3,596,374 | 8/1971 | Covington | 36/125 |
| 4,446,635 | 5/1984 | Hayden, Jr. | 36/124 |
| 5,493,794 | 2/1996 | McKenzie et al. | 36/122 |

FOREIGN PATENT DOCUMENTS

| | | | |
|---|---|---|---|
| 1039764 | 10/1978 | Canada | 36/122 |
| 1074356 | 3/1980 | Canada | 36/122 |
| 1142974 | 3/1983 | Canada | 36/122 |

*Primary Examiner*—B. Dayoan
*Assistant Examiner*—J. Mohandesi

[57] ABSTRACT

A snowshoe attachment is provided including a resilient assembly including a top extent having a front end connected to a snowshoe and a second end rested thereon. The resilient assembly further includes a bottom extent forming a pocket with the top extent. A boot of a user is situated in the pocket for maintaining the same secured to the snowshoe. The boot may be removed by the lifting of the second end of the top extent.

2 Claims, 2 Drawing Sheets

FIG 1
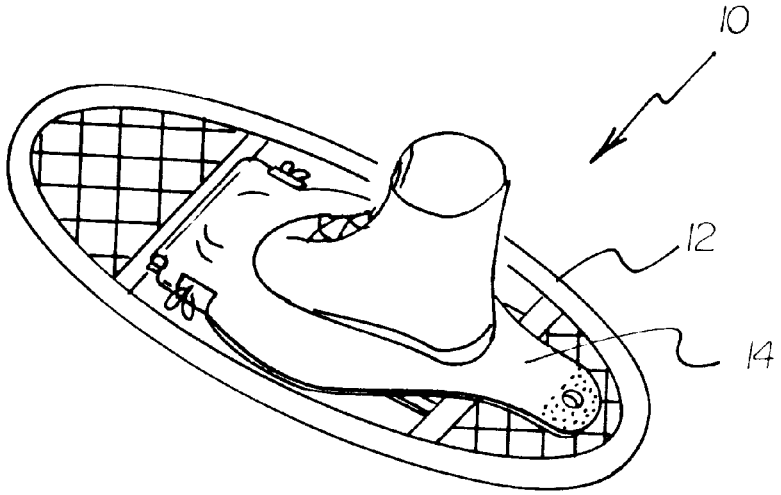
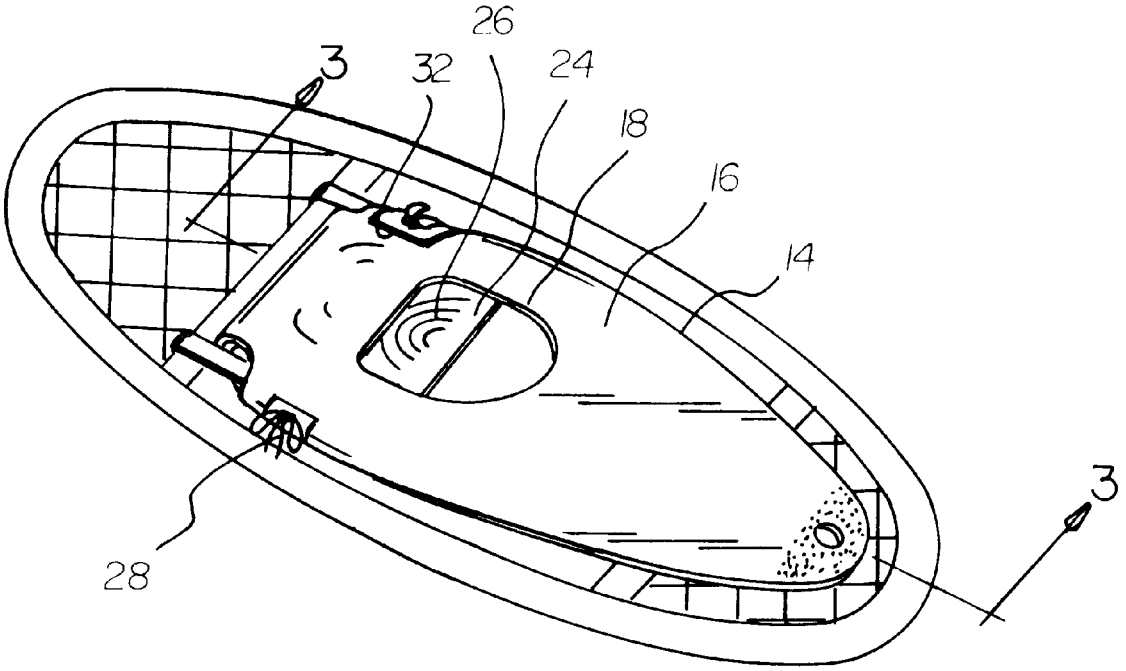
FIG 2

FIG 3
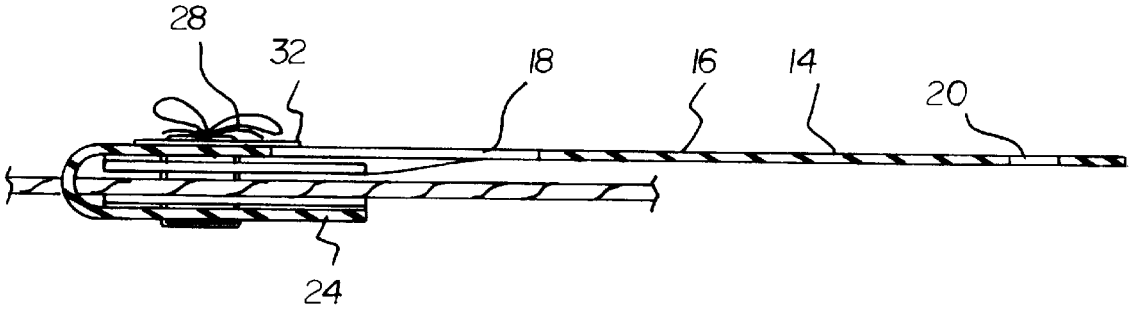
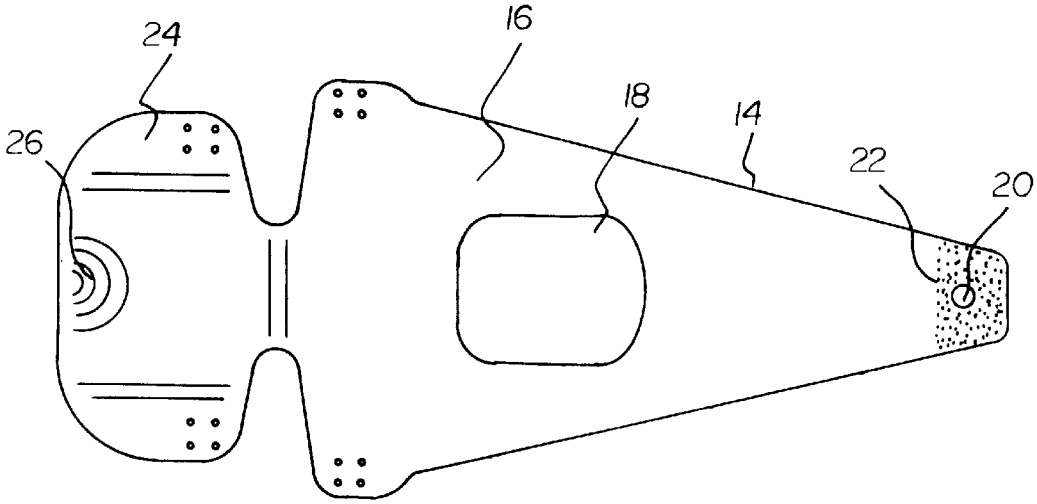
FIG 4

SNOWSHOE FOOT CLAMP

BACKGROUND OF THE INVENTION

1. Field of the Invention

The present invention relates to snowshoe foot securement devices and more particularly pertains to a new snowshoe foot clamp for securely fastening a foot of a user to a snowshoe.

2. Description of the Prior Art

The use of snowshoe foot securement devices is known in the prior art. More specifically, snowshoe foot securement devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art snowshoe foot securement devices include U.S. Pat. No. 3,885,327; U.S. Pat. No. 5,253,437; U.S. Pat. No. 5,341,582; U.S. Pat. No. 4,720,928; U.S. Pat. Des. No. 302,031; and U.S. Pat. No. 5,309,652.

In these respects, the snowshoe foot clamp according to the present invention substantially departs from the conventional concepts and designs of the prior art, and in so doing provides an apparatus primarily developed for the purpose of securely fastening a foot of a user to a snowshoe.

SUMMARY OF THE INVENTION

In view of the foregoing disadvantages inherent in the known types of snowshoe foot securement devices now present in the prior art, the present invention provides a new snowshoe foot clamp construction wherein the same can be utilized for securely fastening a foot of a user to a snowshoe.

The general purpose of the present invention, which will be described subsequently in greater detail, is to provide a new snowshoe foot clamp apparatus and method which has many of the advantages of the snowshoe foot securement devices mentioned heretofore and many novel features that result in a new snowshoe foot clamp which is not anticipated, rendered obvious, suggested, or even implied by any of the prior art snowshoe foot securement devices, either alone or in any combination thereof.

To attain this, the present invention generally comprises a snowshoe having a generally oval periphery. A pair of lateral strips are connected between opposite sides of the periphery adjacent to a front and a rear of the snowshoe. Associated therewith is a pair of longitudinal straps each coupled to opposite ends of the pair of lateral strips in perpendicular relationship therewith. Note FIGS. 1 & 2. The present invention further includes a resilient planar assembly having a top extent with a generally triangular configuration. As best shown in FIG. 4, the top extent is equipped with a large generally rectangular cut out formed in a central extent thereof. A small circular aperture is formed in a rear apex of the top extent for reasons that will soon become apparent. A gripping material is situated on a surface of the rear apex around the circular aperture. Extending from opposite sides of a front of the top extent is a pair of ears each with a plurality of apertures formed therein. The resilient planar assembly further includes a bottom extent with a generally rectangular configuration. The bottom extent has a front edge integrally coupled to the front of the top extent. During use, the bottom extent is situated beneath the top extent with a rear edge of the bottom extent laterally bisecting the rectangular cut out of the top extent. Undulations are formed in a top surface of the top extent adjacent to the rear edge thereof, as shown in FIG. 2. FIG. 4 shows a plurality of apertures formed adjacent to side edges of the bottom extent. In use, the ears of the top extent are folded over to define sleeves with the side edges of the bottom extent through which the longitudinal straps are situated. The resilient planar assembly is thereby maintained in general coplanar relationship with the snowshoe. Further, the rear apex of the top extent resides atop a rear one of the lateral strips, as shown in FIG. 4. By this structure, a boot of a user is situated within the rectangular cut out of the top extent. As such, the boot is maintained secured to the snowshoe. After use, the boot may be removed by the lifting of the rear apex of the top extent.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new snowshoe foot clamp apparatus and method which has many of the advantages of the snowshoe foot securement devices mentioned heretofore and many novel features that result in a new snowshoe foot clamp which is not anticipated, rendered obvious, suggested, or even implied by any of the prior art snowshoe foot securement devices, either alone or in any combination thereof.

It is another object of the present invention to provide a new snowshoe foot clamp which may be easily and efficiently manufactured and marketed.

It is a further object of the present invention to provide a new snowshoe foot clamp which is of a durable and reliable construction.

An even further object of the present invention is to provide a new snowshoe foot clamp which is susceptible of a low cost of manufacture with regard to both materials and labor, and which accordingly is then susceptible of low prices of sale to the consuming public, thereby making such snowshoe foot clamp economically available to the buying public.

Still yet another object of the present invention is to provide a new snowshoe foot clamp which provides in the apparatuses and methods of the prior art some of the advantages thereof, while simultaneously overcoming some of the disadvantages normally associated therewith.

Still another object of the present invention is to provide a new snowshoe foot clamp for securely fastening a foot of a user to a snowshoe.

Even still another object of the present invention is to provide a new snowshoe foot clamp that includes a resilient assembly including a top extent having a front end connected to a snowshoe and a second end rested thereon. The resilient assembly further includes a bottom extent forming a pocket with the top extent. A boot of a user is situated in the pocket for maintaining the same secured to the snowshoe. The boot may be removed by the lifting of the second end of the top extent.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new snowshoe foot clamp according to the present invention.

FIG. 2 is a detailed perspective view of the present invention.

FIG. 3 is a side cross-sectional view of the present invention taken along line 3—3 shown in FIG. 2.

FIG. 4 is a top view of the present invention.

DESCRIPTION OF THE PREFERRED EMBODIMENT

With reference now to the drawings, and in particular to FIGS. 1 through 4 thereof, a new snowshoe foot clamp embodying the principles and concepts of the present invention and generally designated by the reference numeral 10 will be described.

The present invention, designated as numeral 10, includes a snowshoe 12 having a generally oval periphery. A pair of lateral strips are connected between opposite sides of the periphery adjacent to a front and a rear of the snowshoe. Associated therewith is a pair of longitudinal straps each coupled to opposite ends of the pair of lateral strips in perpendicular relationship therewith. Note FIGS. 1 & 2.

The present invention includes a resilient planar assembly 14 having a top extent 16 with a generally triangular configuration. As best shown in FIG. 4, the top extent is equipped with a large generally rectangular cut out 18 formed in a central extent thereof. A small circular aperture 20 is formed in a rear apex of the top extent for reasons that will soon become apparent.

A gripping material 22 is situated on a surface of the rear apex around the circular aperture. Extending from opposite sides of a front of the top extent is a pair of ears each with a plurality of apertures formed therein. In the preferred embodiment, the top extent of the resilient planar assembly has a length which is at least ¾ that of the snowshoe. Further, at its widest extent, the top extent has a width approximately equal to that of the snowshoe.

The resilient planar assembly further includes a bottom extent 24 with a generally rectangular configuration. The bottom extent has a front edge integrally coupled to the front of the top extent. During use, the bottom extent is situated beneath the top extent with a rear edge of the bottom extent laterally bisecting the rectangular cut out of the top extent. The bottom extent is thus resiliently and flexibly hinged with respect to the top face.

High flex elastic undulations 26 are formed in a top surface of the bottom extent adjacent to the rear edge thereof, as shown in FIG. 2. As shown in such Figure, the high flex elastic undulations are semi-circular and concentric in nature. FIG. 4 shows a plurality of apertures formed adjacent to side edges of the bottom extent.

In use, the ears of the top extent are folded over to define sleeves with the side edges of the bottom extent. It is through these sleeves that the longitudinal straps are situated. Note FIG. 3. In the preferred embodiment, the apertures of the top and bottom extents are offset for providing a cup for easier foot insertion, as will become apparent. The coupling between the top and bottom extents is preferably accomplished by way of a durable cord 28. In alternate embodiments, VELCRO or other types of fasteners may be employed.

Further, it is preferred that a pair rigid planar plates 32 are provided each with apertures formed therein. As shown in FIGS. 2 & 3, the apertures of such plates are adapted to receive the cord such that the plates reside on top of the top extent of the resilient planar assembly. The plates thus afford additional durability.

The entire resilient planar assembly is therefore maintained in general coplanar relationship with the snowshoe. Further, the rear apex of the top extent resides atop a rear one of the lateral strips, as shown in FIG. 4. By this structure, a boot of a user is situated within the rectangular cut out of the top extent. As such, the boot is maintained secured to the snowshoe during operation. After use, the boot may be removed by the lifting of the rear apex of the top extent or simply lifting a heel of the boot while depressing the tail of top extent.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A snowshoe attachment comprising, in combination:

a snowshoe including a generally oval periphery, a pair of lateral strips connected between opposite sides of the periphery adjacent to a front and a rear of the snowshoe, and a pair of longitudinal straps each coupled to opposite ends of the pair of lateral strips in perpendicular relationship therewith;

a resilient planar assembly including a top extent with a generally triangular configuration, a large generally rectangular cut out formed in a central extent thereof, a small circular aperture formed in a rear apex of the top extent, a gripping material formed on a top surface of the rear apex around the circular aperture, and a pair of ears each extending from opposite sides of a front of the top extent each with a plurality of apertures formed therein;

said resilient planar assembly further including a bottom extent with a generally rectangular configuration, the bottom extent having a front edge integrally coupled to the front of the top extent such that the bottom extent is situated beneath the top extent with a rear edge of the bottom extent laterally bisecting the rectangular cut out of the top extent, the bottom extent having undulations formed in a top surface thereof and adjacent to the rear edge thereof, and a plurality of apertures formed adjacent to side edges of the bottom extent;

said ears of the top extent being folded over to define sleeves with the side edges of the bottom extent through which the longitudinal straps are situated, the resilient planar assembly thus being maintained in general coplanar relationship with the snowshoe with the rear apex of the top extent residing atop a rear one of the lateral strips, whereby a boot of a user is situated within the rectangular cut out of the top extent and between the top and bottom extents for maintaining the same secured to the snowshoe.

2. A snowshoe attachment comprising:

a snowshoe including a generally oval periphery, a pair of lateral strips connected between opposite sides of the periphery adjacent to a front and a rear of the snowshoe, and a pair of longitudinal straps each coupled to opposite ends of the pair of lateral strips; and a resilient assembly including a top extent having a front end connected to the snowshoe and a second end rested thereon, the top extent having a generally triangular configuration, a large cut out formed in a central extent thereof, a small aperture formed in a rear apex of the top extent, a gripping material formed on a top surface of the rear apex around the aperture, and a pair of ears each extending from opposite sides of a front of the top extent each with a plurality of apertures formed therein;

said resilient assembly further including a bottom extent forming a pocket with the top extent, the bottom extent having a generally rectangular configuration having a front edge integrally coupled to the front of the top extent such that the bottom extent is situated beneath the top extent with a rear edge of the bottom extent laterally bisecting the rectangular cut out of the top extent, the bottom extent having undulations formed in a top surface thereof and adjacent to the rear edge thereof and a plurality of apertures formed adjacent to side edges of the bottom extent; and said ears of the top extent being folded over to define sleeves with the side edges of the bottom extent through which the longitudinal straps are situated, the resilient planar assembly thus being maintained in general coplanar relationship with the snowshoe with the rear apex of the top extent residing atop a rear one of the lateral strips;

whereby a toe portion of a foot of a user is situated in the pocket for maintaining the same secured to the snowshoe, a sole of the foot frictionally engaging the undulations of the bottom extent.

* * * * *